US007647653B1

(12) United States Patent
Catania

(10) Patent No.: US 7,647,653 B1
(45) Date of Patent: Jan. 19, 2010

(54) RETROFIT SOAP DISPENSER FOR WATER FAUCET

(76) Inventor: John Richard Catania, 9186 S. Mountain Brush Ct., Highlands Ranch, CO (US) 80130

( * ) Notice: Subject to any disclaimer, the term of this patent is extended or adjusted under 35 U.S.C. 154(b) by 790 days.

(21) Appl. No.: 11/267,447

(22) Filed: Nov. 4, 2005

(51) Int. Cl.
*A47K 1/04* (2006.01)

(52) U.S. Cl. ..... 4/628

(58) Field of Classification Search ..... 4/286, 4/294; 222/52
See application file for complete search history.

(56) References Cited

U.S. PATENT DOCUMENTS

| | | | | |
|---|---|---|---|---|
| 943,458 | A | 12/1909 | Podmore | |
| D178,998 | S | 10/1956 | Graff | |
| D178,999 | S | 10/1956 | Graff | |
| D179,000 | S | 10/1956 | Graff | |
| 3,018,489 | A * | 1/1962 | Saflarski | 4/628 |
| 3,078,471 | A | 2/1963 | Knibb | |
| 4,938,384 | A * | 7/1990 | Pilolla et al. | 222/52 |
| 5,050,247 | A | 9/1991 | Hsu | |
| 5,226,566 | A | 7/1993 | Brandenburg | |
| 5,625,908 | A | 5/1997 | Shaw | |
| D458,988 | S | 6/2002 | Schroder | |
| 6,484,330 | B2 | 11/2002 | Gray | |
| 6,568,569 | B1 * | 5/2003 | Betz | 222/321.1 |
| 6,718,568 | B1 | 4/2004 | Hensley | |
| 2001/0010316 | A1 * | 8/2001 | Parsons et al. | 222/52 |

FOREIGN PATENT DOCUMENTS

| | | | |
|---|---|---|---|
| DE | 3917238 | A1 | 11/1990 |
| GB | 2136923 | A | 9/1984 |
| GB | 2136923 | A * | 9/1984 |
| JP | 04216727 | A | 6/1992 |

* cited by examiner

*Primary Examiner*—Huyen Le
*Assistant Examiner*—Karen Younkins
(74) *Attorney, Agent, or Firm*—Holland & Hart LLP

(57) ABSTRACT

An exemplary embodiment includes a soap dispenser designed to fit into a water faucet having a stopper-closing lift rod. The rod is removed, and the dispenser tube is inserted into the faucet base hole and down under the counter where the tube is connected to a reservoir of liquid soap. Pressing down on the top of the soap dispenser produces liquid soap through a soap spout above the water faucet spout. Pulling up on the dispenser closes the sink stopper, and pushing down opens the sink stopper. The method of doing the retrofit is also claimed, as well as electrically and mechanically operated versions.

20 Claims, 6 Drawing Sheets

SECTION A-A
29
9
33
5
3
4
2
1
A
A
15
7
6
8
26
14
23
25
24
11
27
17
32
12
30
13
28
16
31

SECTION A-A

RETROFIT SOAP DISPENSER FOR WATER FAUCET

BACKGROUND

One very useful embodiment of the Invention relates to the following field, although the Invention may also relate to other fields. The field of the Invention includes a retrofit soap dispensing device for a water faucet such as is typically found in bathrooms.

DESCRIPTION OF RELATED ART

Typical of the prior art related to the more widely useful embodiments of the present Invention include the following patents. The following examples of related art and its limitations are illustrative and not exclusive. Other limitations of the related art will become apparent to those skilled in the art upon study of the specification and drawings of this Application.

Representative of related art is UK Patent Application GB2136923A which discloses a dispenser for liquid soap near the water spout. The dispenser appears to work through a hole in the faucet base but is apparently not connected to the mechanism which operates the drain stopper. The patent suggests that another hole in the faucet base could accommodate a rod to actuate the stopper mechanism. However, this invention is not a retrofit for a typical American bathroom sink faucet which contains a hole for the stopper lift rod. U.S. Pat. No. 6,718,568 discloses a liquid soap dispenser mounted to the side of a unilever faucet. Again, the soap dispenser itself is not a retrofit but is an integral part of a specially designed faucet. There is no indication that the soap dispenser controls the stopper mechanism. U.S. Pat. No. 3,018,489 discloses a soap dispenser where the soap dispensing tube is inside the water spout of the faucet. This may create problems with obtaining pure water from the water faucet since some residue of soap may be released into the water coming out of the spout. In this patent, the stopper lift rod is retained and extends down through this faucet base underneath the sink. Apparently upward or downward motion of the stopper lift rod actuates the sink drain stopper mechanism and dispenses soap. This invention is not a retrofit for an existing bathroom faucet with a stopper lift rod, but instead involves an elaborate mechanism which is claimed to dispense soap with the motion of the stopper lift rod, whether the stopper is opened or closed.

Regarding U.S. Pat. No. 3,018,489, the Applicant does not understand one claimed aspect of this invention. In column 3, lines 20-23 it is stated that the soap ejector is usable when the drain is open or closed; however Applicant does not understand how this can be true because that would mean that there is not enough travel of the rod which activates the soap pump. Applicant questions the claimed functioning of this arrangement. The differences and advantages of the present Invention compared to this Patent are as follows. The Invention is a retrofit which involves removing the sink stopper lift rod completely and replacing it with the dispenser tube of the Invention. In the Patent, the sink stopper lift rod is unchanged and remains in place. In the Invention, the bottom of the dispenser tube is attached to the flexible soap tube which leads to the soap reservoir. In the Patent, the bottom of the sink stopper lift rod is ultimately attached to the pump inside the soap reservoir. In the Patent, when soap is dispensed by pumping the sink stopper rod, the drain would apparently be closed contrary to the statement in the Patent that the soap can be pumped with the drain either open or closed.

SUMMARY

One of the more widely useful embodiments of the present Invention may be summarized as follows. This embodiment is exemplary only. Other embodiments will become apparent to those skilled in the art upon study of the specification and drawings of this application. One embodiment of the Invention is a device installed in a typical bathroom water faucet having a lift rod that controls the sink stopper. The sink stopper lift rod is removed and replaced by the dispenser tube of the Invention. This tube is connected to the connecting rod which is connected to the stopper actuator in the sink drain pipe. Further details are as follows. The sink lift stopper rod (not shown in the drawings) extends through a faucet base and counter hole 18 in the faucet base 4 from above the faucet base, and down under the counter top 2 where it is connected to a connecting rod 8 which connects to the stopper actuator 7 in the sink drain pipe 6. To install the Invention, the sink stopper lift rod is removed by disconnecting it under the sink from the connecting rod 8. The sink stopper lift rod is then removed by pulling it vertically up through the faucet base and counter hole 18. The dispenser tube 11 of the Invention is then inserted down through faucet base and counter hole 18 and connected to the connecting rod 8, so that downward hand pressure on the soap spout 9 and soap pump 10 causes soap to be sucked from the soap reservoir under the sink and dispensed through the soap spout 9. Upward hand pressure on the soap pump 10 and soap spout 9 causes the dispenser tube to move upward, and by means of its connection to the connecting rod 8, causes the stopper actuator 7 to close the drain pipe 6.

PURPOSES AND ADVANTAGES

The purposes and advantages of the more widely useful embodiments of the present Invention include, but are not limited to, the following, and may include other purposes and advantages in different fields of use:

1. To provide a device which dispenses liquid soap and is a retrofit for a typical American bathroom sink faucet which has a stopper lift rod that extends through the faucet base and under the counter to operate the stopper mechanism.
2. To provide a device which is mechanically simple and easy to make.
3. To provide a device which is inexpensive.
4. To provide a retrofit soap dispenser which is very easily and quickly installed (typically under 10 minutes), and involves no drilling or measuring.
5. To provide a retrofit soap dispenser which retains the same stopper operation as the traditional stopper lift rod.
6. To provide a device which is aesthetically attractive because of its shape and which may be given attractive surface treatments such as a shiny metal appearance, various colors, etc.
7. To provide a soap dispenser which does not require drilling another hole in the counter top.
8. To provide a soap dispenser which will dispense soap on the user's hands when the hands are near the faucet spout, and without leaking soap onto the sink counter.
9. To provide a soap dispenser which may have on it images which are attractive to children and which may motivate them to wash their hands with the soap.
10. To provide a device which frees up bathroom counter space and improves the counter area.
11. To dispense soap from large bottles, which may be more economical, and to avoid messy and inconvenient refilling of the soap reservoir of conventional dispensers.

12. To provide a device which avoids leaving soap residue and dirty water drops all over the counter, which is often caused by use by teenagers and children.

DRAWING FIGURES

FIG. 1 is an overall sectional view of the Invention in place in the faucet base and extending under the counter to control the stopper actuator.

FIG. 2 is a similar view showing a dispenser, with reinforced base and a means for securing the dispenser underneath the counter by means of screw threads and threaded nut.

FIG. 3 is a close-up view showing a portion of what is shown in FIG. 2.

FIG. 4 is a perspective view of the faucet with the soap dispenser pump in place.

FIG. 5 shows a version of the Invention where the soap is dispensed by pressing an electric switch button on the top of the dispenser thereby activating an electric pump underneath the sink.

FIG. 6 is a close-up of Section A-A.

REFERENCE NUMERALS IN DRAWINGS

1 sink
2 counter top
3 faucet spout
4 faucet base
5 water valve knob
6 drain pipe
7 stopper actuator
8 connecting rod
9 soap spout
10 soap pump
11 dispenser tube
12 flexible soap tube
13 soap reservoir
14 stopper actuator bracket
15 stopper actuator bracket clamp
16 soap
17 tube junction
18 faucet base and counter hole
19 counter cabinet
20 reinforced pump base
21 screw threads
22 threaded nut
23 dispenser tube sleeve
24 bracket hole
25 switch wire
26 power pack
27 power wire
28 power plug
29 switch button
30 electric soap pump
31 soap tube
32 pump wire
33 soap spout base
34 mounting sleeve
35 cabinet bottom

BRIEF DESCRIPTION OF THE DRAWINGS

This Brief Description and the Detailed Description cover only some embodiments of the Invention, and other embodiments will be clear to those skilled in the art from the description, drawings, and Alternative and Additional Embodiments. The Drawings are illustrative and not limiting.

In FIG. 5 there is a soap spout base 33 which merely supports switch button 29 and soap spout 9, instead of containing the soap pump itself.

DETAILED DESCRIPTION OF THE DRAWINGS

Figure 1:
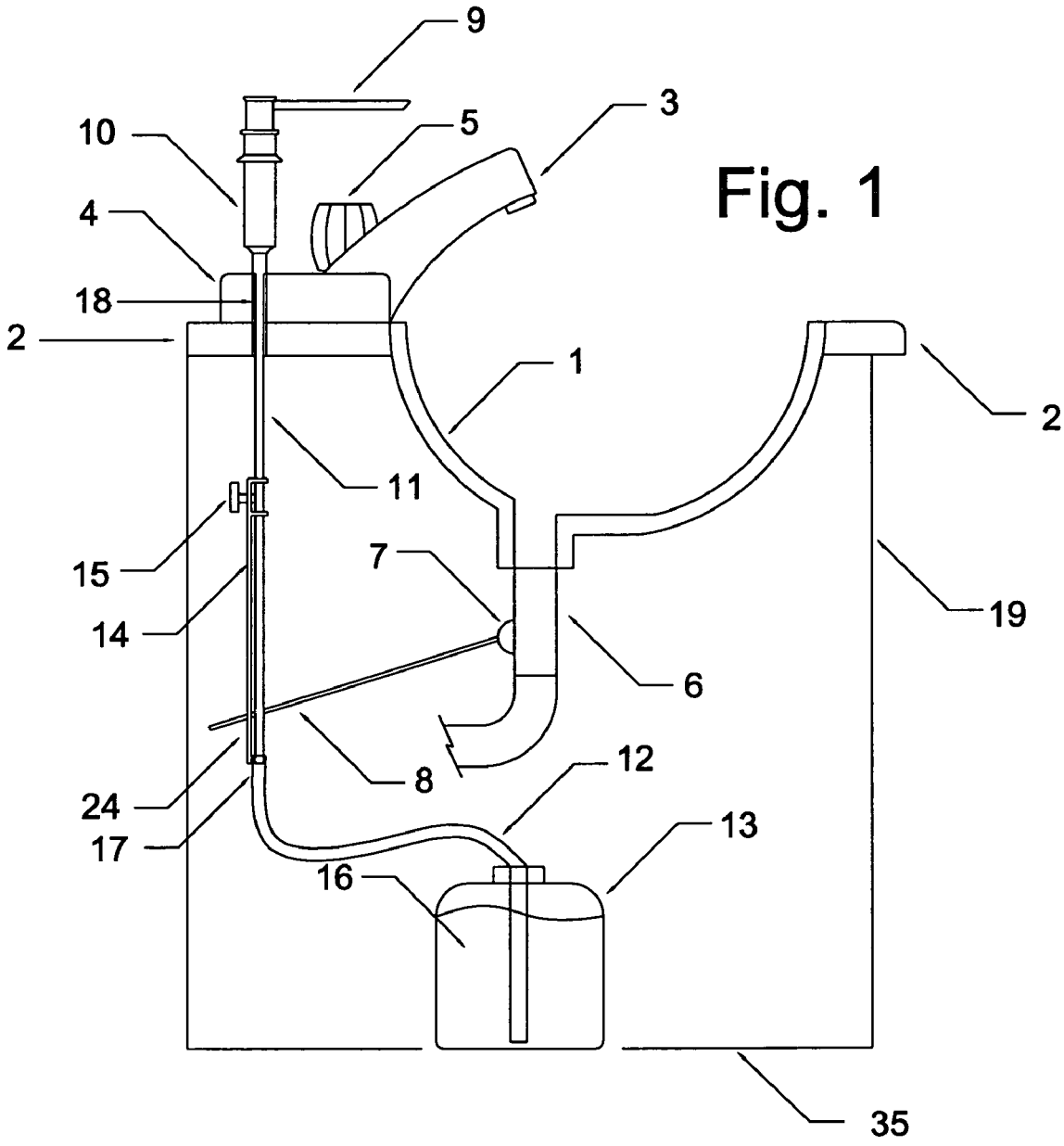
FIG. 1 shows the Invention in place and extending through the hole in the faucet base down beneath the countertop where it is connected to a stopper actuator bracket which in turn is connected to connecting rod which activates the stopper actuator. In this FIG. 1 the stopper lift rod which was originally furnished with the faucet has been removed and replaced by the Invention.

FIG. 1 shows the Invention in place in the faucet base and counter hole 18 after the stopper lift rod which traditionally is part of the faucet assembly has been removed. The Figure shows the sink 1 in place in countertop 2 of counter cabinet 19. The faucet base 4 is shown as well as faucet spout 3, and water valve knob 5. The drain pipe 6 of the sink is shown in partial view as well as stopper actuator 7 and connecting rod 8 which operates stopper actuator 7 when the connecting rod 8 is moved up or down. When connecting rod 8 is moved up, the stopper actuator 7 closes the drain pipe 6, and when connecting rod 8 is moved down, the stopper actuator 7 opens the drain pipe 6. The soap pump 10 is shown attached to soap spout 9, and dispenser tube 11 is shown extending down from soap pump 10 to tube junction 17 were a flexible soap tube 12 is attached to the open end of the dispenser tube 11. Attached to dispenser tube 11 is stopper actuator bracket 14 which is attached to dispenser tube 11 by stopper actuator bracket clamp 15. The connecting rod 8 is attached to stopper actuator bracket 14 by passing through bracket hole 24. The connecting rod 8 may be secured in the hole by means of a leaf spring (not shown) or by other means well known to those skilled in the art. When the soap pump 10 or soap spout 9 is pulled up by the hand of a user, the dispenser tube 11 moves up, as does the attached stopper actuator bracket 14 which causes connecting rod 8 to move up, thus moving stopper actuator 7 to close the drain pipe 6. When soap spout 9 or soap pump 10 are moved down by the hand of a user, dispenser tube 11 also moves down thus causing connecting rod 8 to move down and causing the stopper actuator 7 to open the drain pipe 6. In addition, when the soap spout 9 is pressed down, soap pump 10 draws liquid soap 16 from soap reservoir 13 up flexible soap tube 12 and soap dispenser tube 11, and forces the soap out of soap spout 9 to the waiting hand of the user. The tube junction 17 typically comprises flexible soap tube 12 attached, by stretching, over the end of dispenser tube 11, with flexible tube 12 being sized to snugly fit over the lower end of dispenser tube 11. Before the Invention is attached to the faucet base 4, the stopper lift rod (which previously extended down through faucet base and counter hole 18 and was connected to connecting rod 8) is removed by releasing the stopper lift rod from connecting rod 8. When the dispenser tube 11 is inserted in place of the stopper lift rod, the stopper actuator bracket 14 is attached to the dispenser tube 11 by means of stopper actuator bracket clamp 15, and the connecting rod 8 is connected to stopper actuator bracket 14 by passing through the bracket hole 24 in stopper actuator bracket 14. The soap reservoir 13 is shown resting on cabinet bottom 35.

Figure 2:
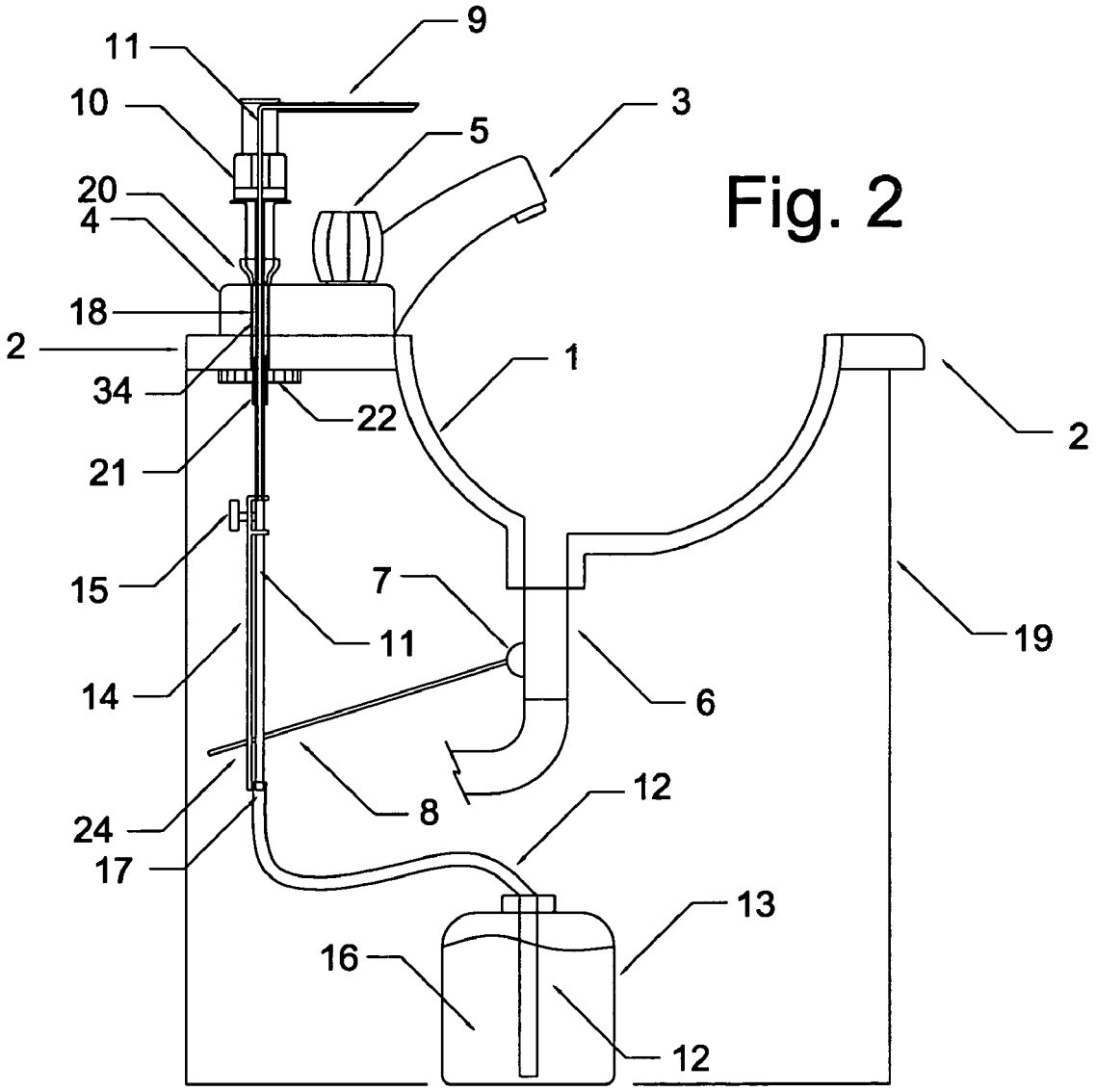
FIG. 2 is very similar to FIG. 1 except that this version of the device is provided with a reinforced pump base 20 and means for securing the Invention in the faucet base by means of screw threads on the dispenser tube sleeve 23 and a threaded nut 22 which is secured underneath the counter surface.

FIG. 2 is essentially the same as FIG. 1, but it shows reinforced pump base 20 which is part of another version of the pump 10. Such pumps are well known to those skilled in the art. In this variation, the dispenser tube 11 is secured by means of screw threads formed in a mounting sleeve 34 (attached to reinforced base 20) which engage the threads in threaded nut 22. When threaded nut 22 is tightened, mounting sleeve 34 is moved down by means of screw threads 21, and reinforced pump base 20 is pulled down against faucet base 4. The dispenser tube 11 is connected to pump 10 and can move up and down through mounting sleeve 34 to move connecting rod 8 to open or close drain pipe 6.

Figure 3:
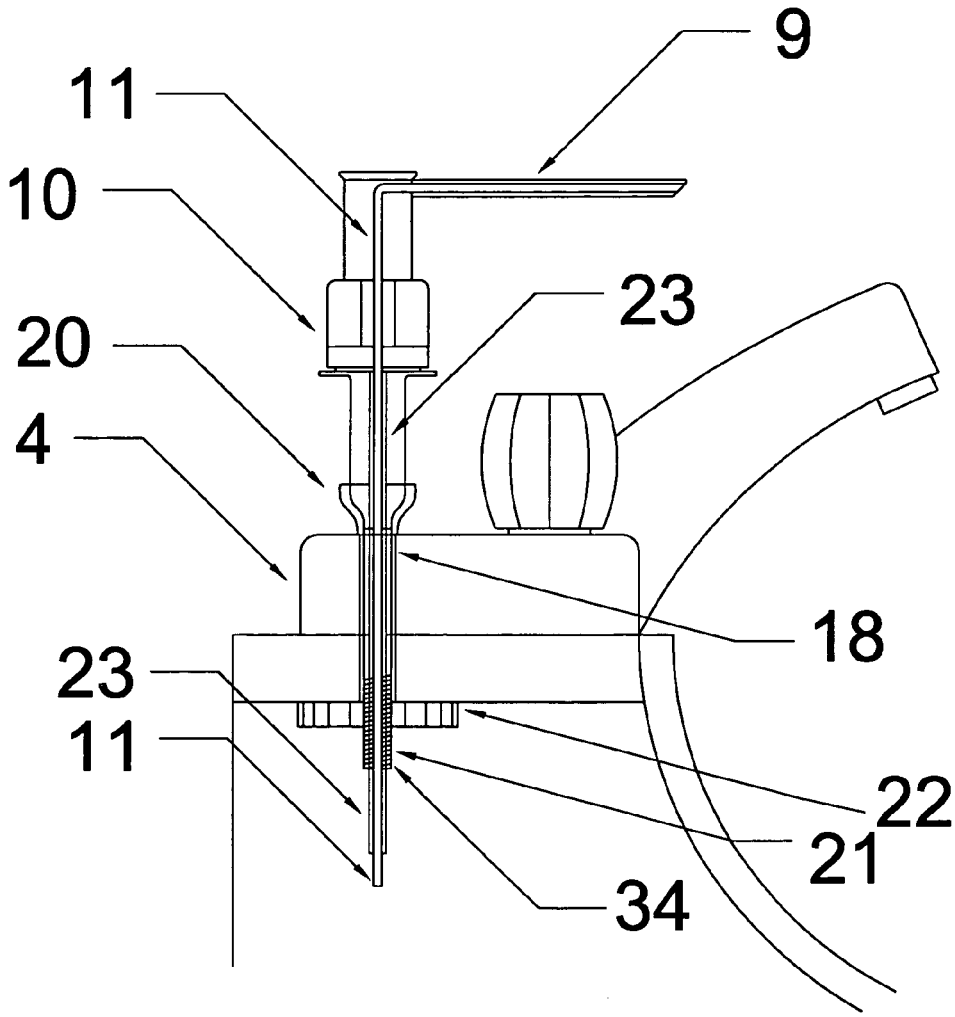
FIG. 3 is merely an enlarged portion of FIG. 2.

FIG. 3 is just a close up a portion of the configuration in FIG. 2.

Figure 4:
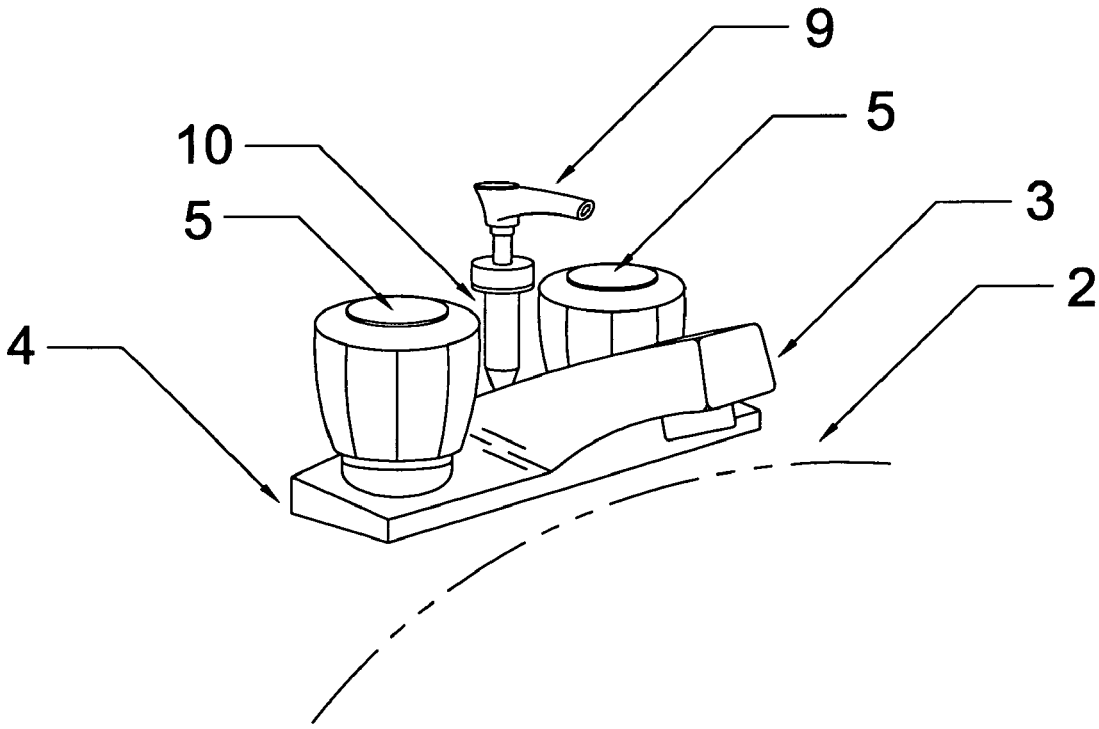
FIG. 4 is a perspective view of the faucet base and faucet spout with the pump 10 in place, the stopper lift rod having been removed and replaced with the Invention.

FIG. 4 is an overall perspective view of the faucet base 4, the faucet spout 3 on counter top 2. Also shown are water valve knobs 5, as well as the Invention in place in the faucet base hole (not shown). The soap pump 10 and soap spout 9 are visible.

Figure 5:
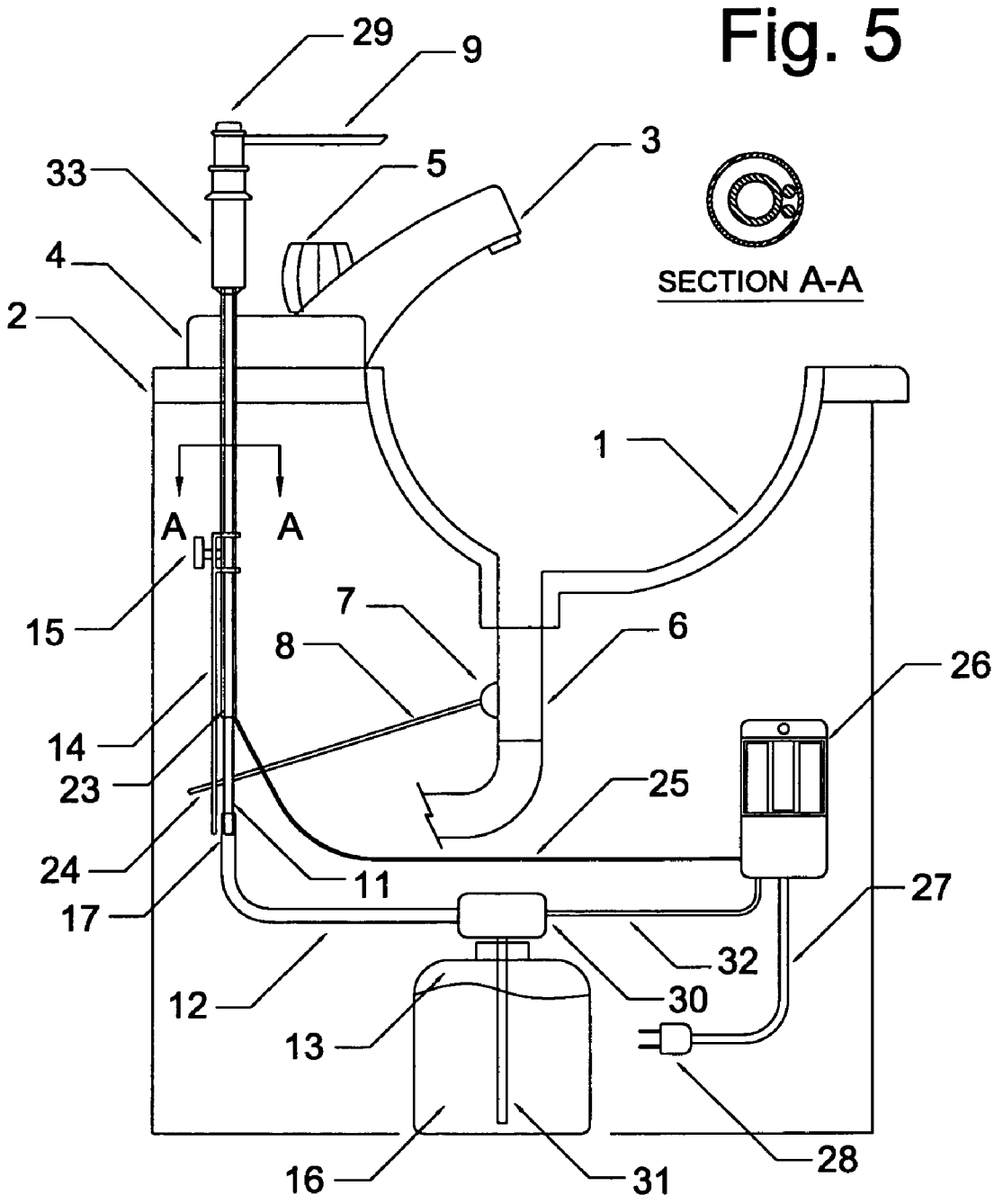
FIG. 5 shows an electrical version of the Invention where, instead of a mechanically operated pump, there is an electrically operated pump which dispenses the soap when a switch button 29 above the soap spout 9 is pressed.

FIG. 5 is very similar to FIG. 1, but it shows the electric pump version of the Invention. To operate this version, the user presses down on electric switch button 29 which is connected by switch wire 25 to power pack 26 which activates electric soap pump 30 through pump wire 32. Power wire 27 and power plug 28 are also shown, although another version of the Invention could use a battery pack instead of a power pack that plugs into an electric outlet. Electric soap pump 30 draws soap 16 up through soap tube 31 and forces it up through flexible soap tube 12, up dispenser tube 11 through soap spout base 33 and out soap spout 9. Switch wire 25 would typically be routed down from switch button 29 and between dispenser tube 11 and the surrounding dispenser tube sleeve 23. The operation of the stopper actuator 7 is the same as in FIG. 1. FIG. 5 also shows a cross section AA taken through dispenser tube sleeve 23. Section AA shows dispenser tube 11 inside dispenser tube sleeve 23 and the two parts of switch wire 25.

Figure 6:
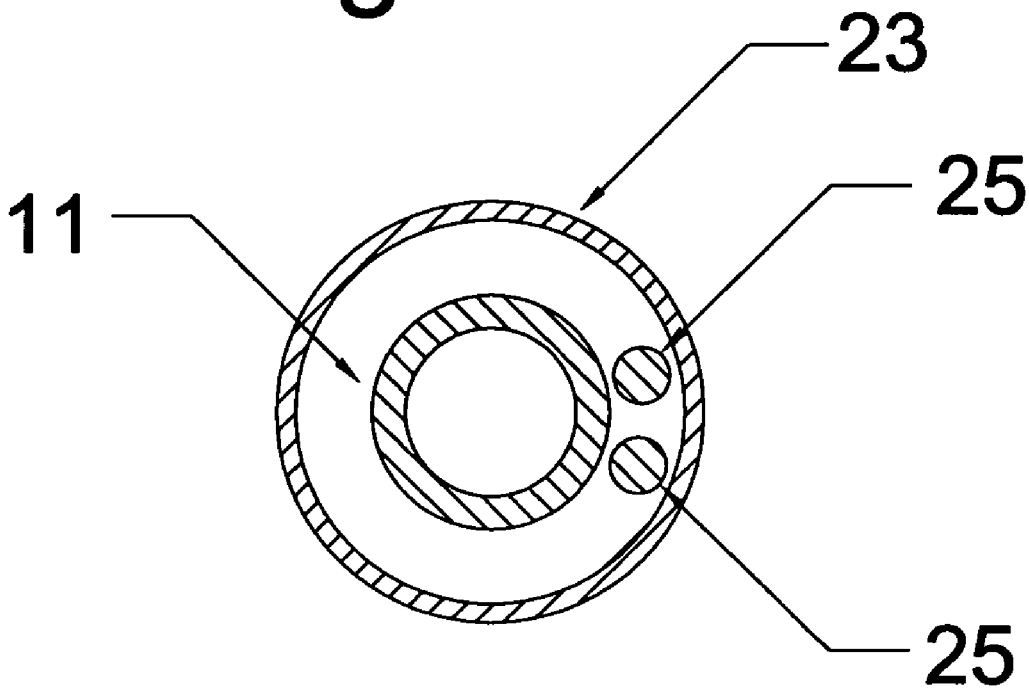
FIG. 6 is a close-up of Section A-A in FIG. 5.

FIG. 6 is a close-up of section A-A in FIG. 5 and shows the two switch wires 25 running down between dispenser tube 11 and dispenser tube sleeve 23.

DESCRIPTION

Preferred Embodiment

The preferred embodiment of the Invention comprises a device for inserting a liquid soap dispenser into a typical bathroom faucet having a faucet base hole for a sink stopper lift rod; it also comprises the method for the retrofit involving disconnecting the sink stopper lift rod from the stopper actuator, pulling it up and out of the faucet base hole, and inserting one embodiment of the Invention down into faucet base hole and connecting it under the sink to the connecting rod which operates the stopper actuator. Details of this embodiment, and by implication, the installation method are shown in FIGS. 1-4.

Operation of One Embodiment

One embodiment of the Invention is a device for inserting a liquid soap pump into an existing bathroom faucet by removing the stopper lift rod which activates the built in sink stopper.

A typical faucet in an American bathroom or utility room comprises a water spout or faucet spout and two associated knobs controlling hot and cold water (or alternatively a lever which controls both hot and cold water). Typically behind the water spout is a vertical stopper lift rod which controls the built in sink stopper; in other words, pulling up on the rod closes the sink stopper, and pushing down on the rod opens the sink stopper. To insert the soap pump of the present Invention, the vertical stopper lift rod is removed from the faucet assembly, and the Invention is inserted into the hole formerly occupied by the vertical rod. The top of the Invention comprises a pump for liquid soap and the bottom portion of the Invention is a stiff tube which goes down in the hole formerly occupied by the vertical lift rod, and attaches to the connecting rod which operates the built in sink stopper. The stiff tube of the Invention (dispenser tube) may contain an internal plastic tube, one end of which is attached to the flexible tube which goes into a sizable reservoir of liquid soap underneath the sink, and the other end of which goes up to the soap pump. When the Invention is in the place of the former vertical stopper lift rod, a user may press down on the Invention and soap is delivered through the soap spout of the soap pump. The user may also pull up on the Invention and close the built-in sink stopper. In essence, the Invention is an easy retrofit for an existing bathroom type faucet, and the retrofit comprises removing the vertical stopper lift rod which operates the built-in sink stopper and replacing it with the Invention. The bottom end of the Invention is easily attached to the connecting rod which operates the built-in sink stopper, by means of a stopper actuator bracket and stopper actuator bracket clamp. The connecting rod may be connected to the stopper actuator bracket by passing through a hole in the bracket.

The Invention allows the liquid soap pump to be installed in an existing sink without drilling another hole in the counter top supporting the sink. Also, the Invention dispenses soap in a much neater way than a separate pump off to the side of the faucet, whether the pump is placed on the countertop or inserted into the countertop. In other words, any soap spilled from the pump of the Invention would go directly into the sink, instead of falling upon the adjacent countertop.

The exact structure and shape of the pump may vary, but in essence it replaces the vertical rod which operates the typical built in sink stopper. There may be a version of the Invention which uses an electrically powered pump instead of a mechanical pump. In that case, the top of the device would contain a switch to activate the pump, but pulling up on the device still causes the built-in sink stopper to close, and pushing down causes the stopper to open. Various materials, colors and finishes may be used on the device as well as ornaments and pictures on the top of the pump.

Tests

The Inventor made an initial version of the Invention and a revised version including a metal reinforced tube sleeve to provide strength and durability. The drain closing lift rod was removed from the sink by the Inventor by simply unscrewing the screw that connects the drain closing hardware underneath the sink. The dispenser tube with sleeve was then inserted through the hole previously occupied by the drain closing lift rod until the pump at the top of the tube seated firmly in the hole at the top of the sink faucet. The screw was then retightened, attaching the drain closing hardware to the dispenser tube with sleeve that used to be the lift rod. Upward and downward motion was successful thus maintaining drain opening and closing operation. The flexible soap tube was attached to the dispenser tube at the bottom of the dispenser tube with sleeve. The other end of the flexible soap tube was inserted into the soap and liquid soap reservoir. In order to accommodate all medium and large soap bottles, a tapered rubber bottle stopper with a hole in it designed to accommodate the flexible soap tube was provided. From day one the Invention has been in use in the Inventor's home and has been flawlessly dispensing soap on an average of 4 to 5 times a day. The operation requires one hand for use—thumb to depress the top and palm to receive the soap. The soap spout can swing to the right or left for either hand for user preference. The installation took less than 10 minutes.

Additional Embodiments

Another embodiment of the Invention could use a battery pack in place of power pack 26, thus avoiding the necessity of connection to an electrical outlet.

The soap pump 10 and soap spout 9 could be replaced by another soap dispensing means including an electric soap pump. The soap dispensing means located above the faucet base could include other embodiments such as a head with a hole or other form known to those skilled in the art.

The stopper actuator bracket could be replaced by another stopper actuator bracket means known to those skilled in the art, for connecting the dispenser tube to the connecting rod. The stopper actuator bracket 14 could be connected to the dispenser tube sleeve 23 as shown in FIG. 5, instead of to dispenser tube 11 as shown in FIG. 1.

The stopper actuator bracket clamp could be replaced by another stopper actuator bracket connecting means known to those skilled in the art, for attaching the stopper actuator bracket to the dispenser tube.

Instead of a retrofit, the Invention could also be sold as part of a new, whole faucet assembly including the faucet base, faucet spout, etc.

CONCLUSIONS, RAMIFICATIONS AND SCOPE

A number of changes are possible to the methods and parts described above while still remaining within the scope and spirit of the Invention. The specifics about the form of the Invention described in this application (including the specifics in the Summary, Abstract, Preferred Embodiment, Additional Embodiments, and Alternative Embodiments) are examples and are not intended to be limiting in scope. Those skilled in the art will recognize certain modifications, permutations, additions, subtractions and sub-combinations thereof. The scope of the Invention is to be determined by the claims and their legal equivalents, not the examples, purposes, summary, preferred embodiments, alternative or additional embodiments, operation, tests, etc. given above. It is intended that the claims are interpreted to include all such modifications, additions, subtractions, permutations and sub-combinations as are within their true spirit and scope.

I claim:

1. A retrofit device for a counter faucet and counter having a sink, a drain-closing mechanism, a sink drain-closing lift rod, and a faucet base and counter hole, and a connecting rod for a drain-closing mechanism, or a part of a new faucet assembly, comprising:

(a) a soap pump having a base portion and a spout portion, the soap pump being removably coupled to and positioned on the top of a faucet, whereby said soap pump is reciprocally movable up and down with respect to the faucet;

(b) a dispenser tube connected to the soap pump and inserted down through a faucet base and counter hole after a lift rod is removed;

(c) a stopper actuator bracket connected to the dispenser tube; and (d) a stopper actuator bracket clamp connecting the stopper actuator bracket to the dispenser tube;

whereby the dispenser tube is operatively coupled with a soap reservoir and whereby a connecting rod for a drain-closing mechanism is operatively coupled with the stopper actuator bracket, whereby a user's pulling up on the soap pump and spout closes the sink drain, and pushing down on the soap pump and spout opens the sink drain, and whereby pushing down on the soap pump dispenses soap into a user's hand.

2. A retrofit device for a counter faucet and counter having a sink, a drain-closing mechanism, a sink drain-closing lift rod, and a faucet base and counter hole, and a connecting rod for a drain-closing mechanism, or a part of a new faucet assembly, comprising:

(a) a soap dispensing means having a base portion, the soap dispensing means being removably coupled to and positioned on the top of a faucet, whereby said soap dispensing means is reciprocally movable up and down with respect to the faucet, (b) a dispenser tube connected to the soap dispensing means and inserted down through a faucet base and counter hole after a lift rod is removed;

(c) a stopper actuator bracket means connected to the dispenser tube; and (d) a stopper actuator bracket connecting means connecting the stopper actuator bracket means to the dispenser tube;

whereby the dispenser tube is operatively coupled with a soap reservoir and whereby a connecting rod for a drain-closing mechanism is operatively coupled with the stopper actuator bracket means, and whereby a user's pulling up on the soap dispensing means closes the sink drain, and pushing down on the soap dispensing means opens the sink drain, and whereby pushing down on the soap dispensing means dispenses soap into a user's hand.

3. The device of claim 1, further comprising a flexible soap tube connected to the open end of the dispenser tube and connected to a soap reservoir.

4. The device of claim 2, further comprising a flexible soap tube connected to the open end of the dispenser tube and connected to a soap reservoir.

5. The device of claim 3, further comprising a dispenser tube sleeve positioned around the dispenser tube, and extending upward at least to the pump base portion and downward to, or near, the open end of the dispenser tube.

6. The device of claim 4, further comprising a dispenser tube sleeve positioned around the dispenser tube, and extending upward at least to the soap dispensing means base portion and downward to, or near, the open end of the dispenser tube.

7. The device of claim 5, further comprising a mounting sleeve positioned around the dispenser tube sleeve and connected to a reinforced pump base, and containing screw threads engaging a threaded nut, whereby when the nut is rotated, the reinforced pump base is held securely against the top opening of the faucet base and counter hole, and the nut is held securely against the bottom surface of the counter.

8. The device of claim 6, further comprising a mounting sleeve positioned around the dispenser tube sleeve and connected to a reinforced pump base, and containing screw threads engaging a threaded nut, whereby when the nut is rotated, the reinforced pump base is held securely against the top opening of the faucet base and counter hole, and the nut is held securely against the bottom surface of the counter.

9. A retrofit device for a counter faucet and counter having a sink, a drain-closing mechanism, a sink drain-closing lift rod, and a faucet base and counter hole, and a connecting rod for a drain-closing mechanism, or a part of a new faucet assembly, comprising:

(a) a soap spout having a base portion, the soap spout being removably coupled to and positioned on the top of a faucet;

(b) a dispenser tube connected to the soap spout and inserted down through a faucet base and counter hole after a lift rod is removed;

(c) a stopper actuator bracket connected to the dispenser tube;

(d) a stopper actuator bracket clamp connecting the stopper actuator bracket to the dispenser tube; and (e) a soap pump which is electrically operated and is positioned underneath the counter between the dispenser tube and a soap reservoir;

whereby the dispenser tube is operatively coupled with to a soap reservoir and whereby a connecting rod for a drain-closing mechanism is operatively coupled with the stopper actuator bracket, and whereby a user's pulling up on the soap spout closes the sink drain, and pushing down on the soap spout opens the sink drain, and whereby pushing down on the soap spout dispenses soap into a user's hand.

10. A retrofit device for a counter faucet and counter having a sink, a drain-closing mechanism, a sink drain-closing lift rod, and a faucet base and counter hole, and a connecting rod for a drain-closing mechanism, or a part of a new faucet assembly, comprising:

(a) a soap dispensing means having a base portion, the soap dispensing means being removably coupled to and positioned on the top of a faucet, whereby said soap dispensing means is reciprocally movable up and down with respect to the faucet;

(b) a dispenser tube connected to the soap dispensing means and inserted down through a faucet base and counter hole after a lift rod is removed;

(c) a stopper actuator bracket means connected to the dispenser tube;

(d) a stopper actuator bracket connecting means connecting the stopper actuator bracket means to the dispenser tube; and (e) a soap pump which is electrically operated and is positioned underneath the counter between the dispenser tube and a soap reservoir;

whereby the dispenser tube is operatively coupled with a soap reservoir and whereby a connecting rod for a drain-closing mechanism is operatively coupled with the stopper actuator bracket means, and whereby a user's pulling up on the soap dispensing means closes the sink drain, and pushing down on the soap dispensing means opens the sink drain, and whereby pushing down on the soap dispensing means dispenses soap into a user's hand.

11. The device of claim 10, further comprising a switch button at or near the top of the soap pump, pump wires connecting the switch button to an electric soap pump, and an electric soap pump.

12. The device of claim 11, further comprising a switch button at or near the top of the soap dispensing means, pump wires connecting the switch button to an electric soap pump, and an electric soap pump.

13. The device of claim 11, further comprising a dispenser tube sleeve positioned around the dispenser tube, and wherein the pump wires are positioned substantially along the axis of the dispenser tube and between the dispenser tube and the dispenser tube sleeve.

14. The device of claim 12, further comprising a dispenser tube sleeve positioned around the dispenser tube, and wherein the pump wires are positioned substantially along the axis of the dispenser tube and between the dispenser tube and the dispenser tube sleeve.

15. The process of adding a soap dispensing capability to a counter faucet and counter having a sink, a drain-closing mechanism, a sink drain-closing lift rod, and a faucet base and counter hole, and a connecting rod for a drain-closing mechanism comprising the steps of:

(a) disconnecting a drain-closing lift rod from a connecting rod under a sink;

(b) removing a drain-closing lift rod by pulling it vertically up and out of a faucet base and counter hole;

(c) inserting a device, comprising a soap pump having a base portion, a spout portion, and a dispenser tube connected to the soap pump, down into a faucet base and counter hole;

(d) connecting the bottom end of the dispenser tube of the device of (c) above to a stopper actuator bracket; and (e) connecting the stopper actuator bracket to a connecting rod;

whereby a user's pulling up or pressing down on the soap pump opens or closes a sink drain, and whereby pressing down on the soap pump dispenses soap into a user's hand.

16. The process of adding a soap dispensing capability to a counter faucet and counter having a sink, a drain-closing mechanism, a sink drain-closing lift rod, and a faucet base and counter hole, and a connecting rod for a drain-closing mechanism comprising the steps of:

(a) disconnecting a drain-closing lift rod from a connecting rod under a sink;

(b) removing a drain-closing lift rod by pulling it vertically up and out of a faucet base and counter hole;

(c) inserting a device comprising, a soap dispensing means having a base portion and a soap dispenser tube connected to the soap dispensing means, down into a faucet base and counter hole;

(d) connecting the bottom end of the dispenser tube of the device of (c) above to a stopper actuator bracket means; and (e) connecting the stopper actuator bracket means to a connecting rod;

whereby a user's pulling up or pressing down on the soap dispensing means opens or closes a sink drain, and whereby pressing down on the soap dispensing means dispenses soap into a user's hand.

17. The process of adding a soap dispensing capability to a counter faucet and counter having a sink, a drain-closing mechanism, a sink drain-closing lift rod, and a faucet base and counter hole, and a connecting rod for a drain-closing mechanism comprising the steps of:

(a) disconnecting a drain-closing lift rod from a connecting rod under a sink;

(b) removing a drain-closing lift rod by pulling it vertically up and out of a faucet base and counter hole;

(c) inserting a device comprising, a soap pump having a base portion, a spout portion, and a dispenser tube connected to the soap pump, and a dispenser tube sleeve positioned around the dispenser tube, down into a faucet base and counter hole;

(d) connecting the bottom end of the dispenser tube sleeve of the device of (c) above to a stopper actuator bracket; and (e) connecting the stopper actuator bracket to a connecting rod;

whereby a user's pulling up or pressing down on the soap pump opens or closes the sink drain, and whereby pressing down on the soap pump dispenses soap into a user's hand.

18. The process of adding a soap dispensing capability to a counter faucet and counter having a sink, a drain-closing mechanism, a sink drain-closing lift rod, and a faucet base and counter hole, and a connecting rod for a drain-closing mechanism comprising the steps of:

(a) disconnecting a drain-closing lift rod from a connecting rod under the sink;

(b) removing a drain-closing lift rod by pulling it vertically up and out of a faucet base and counter hole;

(c) inserting a device comprising, a soap dispensing means having a base portion, a dispenser tube connected to the soap dispensing means, a dispenser tube sleeve positioned around the dispenser tube, down into a faucet base and counter hole;

(d) connecting the bottom end of the dispenser tube sleeve of the device of (c) above to a stopper actuator bracket means; and (e) connecting the stopper actuator bracket means to a connecting rod;

whereby a user's pulling up or pressing down on the soap dispensing means opens or closes the sink drain, and whereby pressing down on the soap dispensing means dispenses soap into a user's hand.

19. A retrofit device for a counter faucet and counter having a sink, a drain-closing mechanism, a sink drain-closing lift rod, and a faucet base and counter hole, and a connecting rod for a drain-closing mechanism, or a part of a new faucet assembly, comprising:

(a) a soap pump having a base portion and a spout portion, the soap pump being removably coupled to and positioned on the top of a faucet, whereby said soap pump is reciprocally movable up and down with respect to the faucet;

(b) a dispenser tube connected to the soap pump and inserted down through a faucet base and counter hole after a lift rod is removed;

(c) a dispenser tube sleeve positioned around the dispenser tube, and extending upward at least to the pump base portion and downward to, or near, the open bottom end of the dispenser tube;

(d) a stopper actuator bracket connected to the dispenser tube sleeve; and (e) a stopper actuator bracket clamp connecting the stopper actuator bracket to the dispenser tube sleeve, whereby the dispenser tube is operatively coupled with a soap reservoir and whereby a connecting rod for a drain-closing mechanism is operatively coupled with the stopper actuator bracket, whereby a user's pulling up on the soap pump and soap spout closes the sink drain, and pushing down on the soap pump and soap spout opens the sink drain, and whereby pushing down on the soap pump and soap spout dispenses soap into a user's hand.

20. A retrofit device for a counter faucet and counter having a sink, a drain-closing mechanism, a sink drain-closing lift rod, and a faucet base and counter hole, and a connecting rod for a drain-closing mechanism, or a part of a new faucet assembly, comprising:

(a) a soap dispensing means having a base portion, the soap dispensing means being removably coupled to and positioned on the top of a faucet, whereby said soap dispensing means is reciprocally movable up and down with respect to the faucet;

(b) a dispenser tube connected to the soap dispensing means and inserted down through a faucet base and counter hole after a lift rod is removed;

(c) dispenser tube sleeve positioned around the dispenser tube, and extending upward at least to the soap dispensing means base portion and downward to, or near, the open bottom end of the dispenser tube;

(d) a stopper actuator bracket means connected to the dispenser tube sleeve; and (e) a stopper actuator bracket connecting means connecting the stopper actuator bracket means to the dispenser tube sleeve;

whereby the dispenser tube is operatively coupled with a soap reservoir and whereby a connecting rod for a drain-closing mechanism is operatively coupled with the stopper actuator bracket means, and whereby a user's pulling up on the soap dispensing means closes the sink drain, and pushing down on the soap dispensing means opens the sink drain, and whereby pushing down on the soap dispensing means dispenses soap into a user's hand.

* * * * *